US005619915A

United States Patent [19]

Wagner et al.

[11] Patent Number: 5,619,915

[45] Date of Patent: Apr. 15, 1997

[54] MANUAL TRASH COMPACTOR

[75] Inventors: William E. Wagner, Satellite Beach; K. N. Singh Chhatwal, West Melbourne, both of Fla.

[73] Assignee: Pack-A-Drum, Inc., Satellite Beach, Fla.

[21] Appl. No.: 536,528

[22] Filed: Sep. 29, 1995

[51] Int. Cl.[6] ..... B30B 9/30

[52] U.S. Cl. ..... 100/98 R; 100/100; 100/226; 100/229 A; 100/255; 100/266; 100/288

[58] Field of Search ..... 100/98 R, 100, 100/102, 226–228, 229 A, 255, 266, 288

[56] References Cited

U.S. PATENT DOCUMENTS

| | | | |
|---|---|---|---|
| 280,333 | 6/1883 | Summers | 100/288 |
| 500,660 | 7/1893 | Kisinger | 100/288 |
| 2,253,123 | 8/1941 | Hart | 100/288 |
| 2,528,276 | 10/1950 | Hoy | 100/288 |
| 3,040,656 | 6/1962 | Du Waldt | 100/288 |
| 3,805,691 | 4/1974 | Sulcek | 100/102 |
| 3,850,094 | 11/1974 | Shontz | 100/226 |
| 3,995,543 | 12/1976 | Montalbano | 100/229 A |

FOREIGN PATENT DOCUMENTS

| | | | |
|---|---|---|---|
| 308312 | 10/1918 | Germany | 100/255 |
| 2254828 | 5/1974 | Germany | 100/288 |
| 84408 | 10/1954 | Norway | 100/226 |

*Primary Examiner*—Stephen F. Gerrity
*Attorney, Agent, or Firm*—Maguire, Voorhis & Wells, P.A.; Robert L. Wolter

[57] ABSTRACT

The present invention is a manually operated trash compactor with a refuse container mounted on a mobile platform. The container has a first section fixed to the platform and a second section pivotally attached to the first section. A latch is mounted to the container to hold the container closed during compaction. A compaction plate is mounted to a rack gear and pinion gear assembly. The assembly is rotatable between a starting position, with the compaction plate disposed over the refuse container, and a position lateral to the container. A drive wheel is connected to the pinion gear to rotate the pinion gear to selectively adjust the rack gear and compaction plate into the container to compress refuse in the container lined with a trash bag. A compression spring is mounted on the rack gear to facilitate automated return of the compaction plate to its starting position. A tension adjuster is in contact with the rack gear to control the rate of return of the rack gear. The compactor is also equipped with a trash bag storage and dispenser device that is mounted on the bottom of plate section air filled container during compression of refuse. Drain holes are drilled in the bottom of container to drain liquid when the compactor is cleaned.

22 Claims, 3 Drawing Sheets

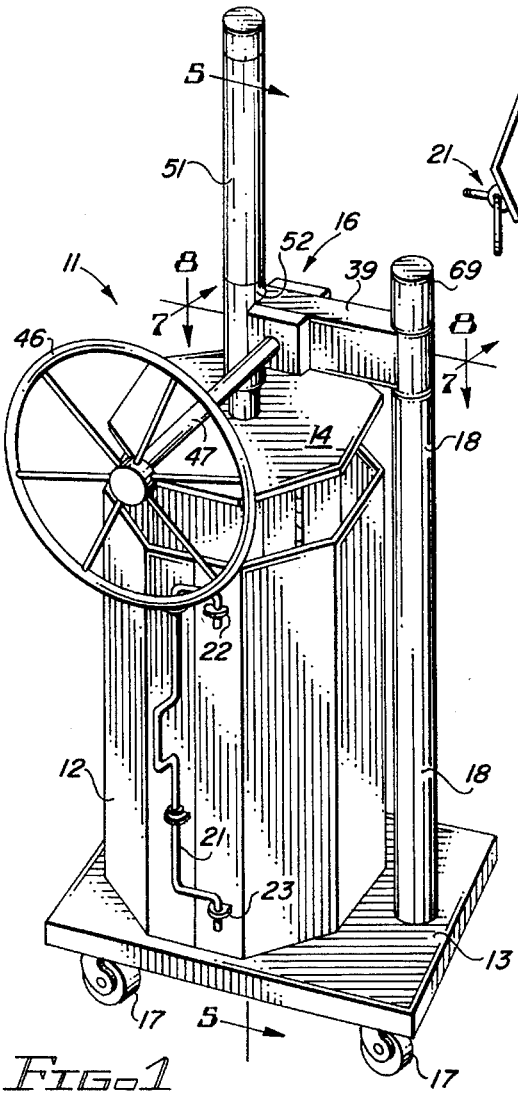
FIG. 1
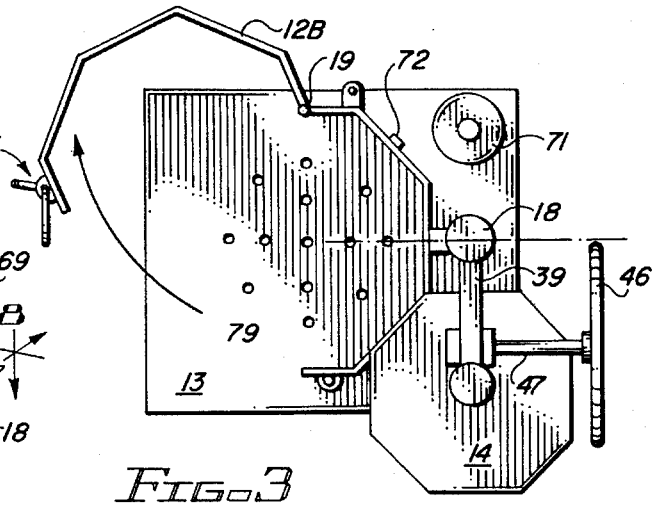
FIG. 3
FIG. 15
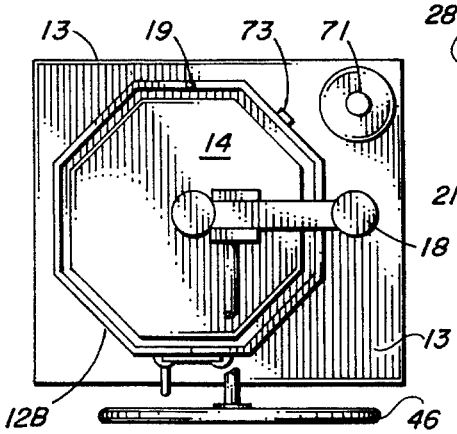
FIG. 2
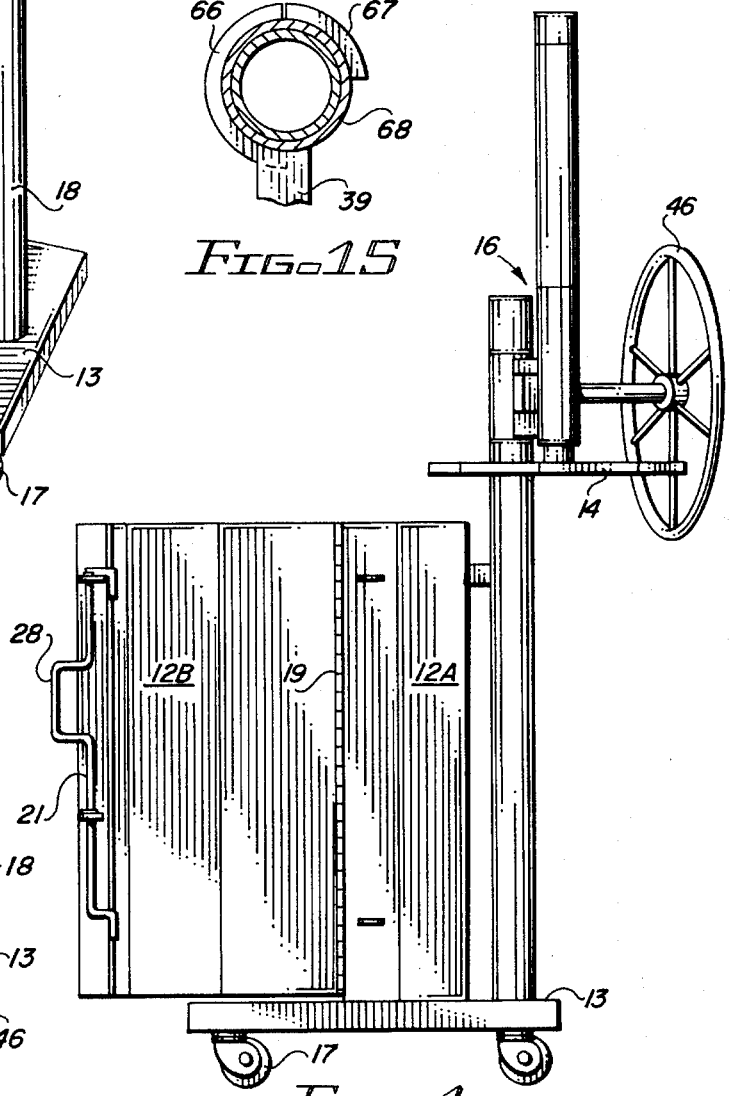
FIG. 4

61
62
64
66
43
52

57
56
14
40

54
50
53
56
52
41
69
72
71
70
83
74

61
48
47
44
11
68
66
39
66A
67
50
50
18
15
68
39
15
66
67
66A
18

41
42
43
14
40
12
12

MANUAL TRASH COMPACTOR

FIELD OF THE INVENTION

The present invention relates to trash or refuse compactors. More specifically, this invention relates to manually operated trash compactors.

BACKGROUND OF THE INVENTION

Much of trash deposited during the course of a business day has a high air volume such as plastic, paper or styrofoam containers. This is especially the case in the restaurant and fast-food industries. This type of refuse creates a large number of bulky refuse-filled trash bags. In many communities throughout the country, private trash removal or "waste management" firms provide refuse removal services to businesses. The cost for such services is basically driven by two elements, including (1) a rental fee based on the size of a refuse container, and (2) a pick-up charge which is equal to the volumetric size of the container multiplied by a unit volumetric charge (per cubic yard rate) times the number of pick-ups per week. Thus, in order for a business to manage the cost of refuse removal services, a business must minimize the size of its refuse containers and the number of pick-ups per week. Consequently, businesses often turn to the use of trash compactors to minimize the number of refuse pick-ups during a set period of time.

Many trash compactors used in a commercial setting are rather large, bulky devices that are electrically and/or hydraulically driven and are usually quite expensive, and require additional expensive equipment to facilitate unloading and transportation of compacted trash. Additionally, if the trash is compacted too tightly there is a risk the waste management firms may increase the rates of the removal charge. The expense of such a machine is especially significant for new businesses. Besides the expense of purchasing and installing these compactors, these compactors may often require an additional maintenance and repair service. Moreover, these large machines may present safety problems in the work place. Such problems may be avoided by using a smaller less complicated compactors.

U.S. Pat. Nos. 4,492,156 and 4,656,937 each disclose trash compactors with a hydraulically driven ram means for compaction of refuse in a container. Trash bags line a container that is adapted to be opened at its side to gain access to the refuse-filled trash bags.

U.S. Pat. No. 3,850,094 issued to Shontz discloses a trash compressor and receptacle that uses a compression plate operated by lever handle. The receptacle has two sections pivotally connected by a hinge to provide access into the receptacle.

SUMMARY OF THE INVENTION

In view of the foregoing, it is object of the present invention to provide an affordable trash compactor. Another object of this invention is to provide an inexpensive compactor that is easy to operate. Still another objective of the present invention is to provide the compactor with a rotatable compactor head Yet another object of this invention is to provide the compactor head with a rack gear and pinion gear system for manual operation of the compaction means of the compactor. Still another object of this invention is to provide the rack gear and pinion gear assembly with a compression spring for automated return of the compaction means to a starting position. A further object of the invention is to provide the compactor with a drive wheel to manually operate the compactor effectively and safely.

Another objective is to provide the compactor with a readily accessible receptacle for removal of refuse filled trash bags. Yet another objective is to provide the receptacle with a latch means for opening and closing the receptacle.

Still another objective is to provide the trash compactor with a trash bag storage and dispenser means. Yet another objective is construct this compactor with rust-proof components so the compactor may be stored or used outside.

Another objective of this invention is to provide a puncture means to vent the air held in the refuse during compaction.

BRIEF DESCRIPTION OF THE DRAWINGS

FIG. 1 perspective view of the trash compactor.

FIG. 2 top view of trash compactor shown in FIG. 1.

FIG. 3 top view of trash compactor container opened.

FIG. 4 side elevational view of trash compactor with the container opened.

FIG. 15 and 16 are sectional views of FIG. 14.

DETAILED DESCRIPTION OF THE DRAWINGS

Figure 5:
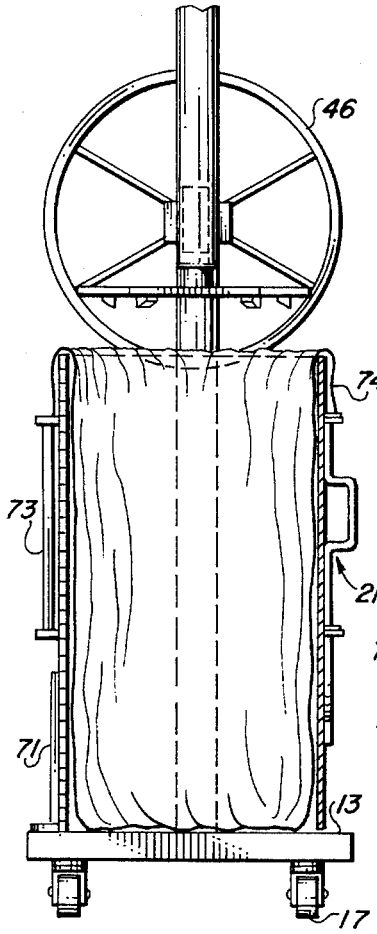
FIG. 5 is a cross sectional view taken along line 5—5 in FIG. 1.
Figure 6:
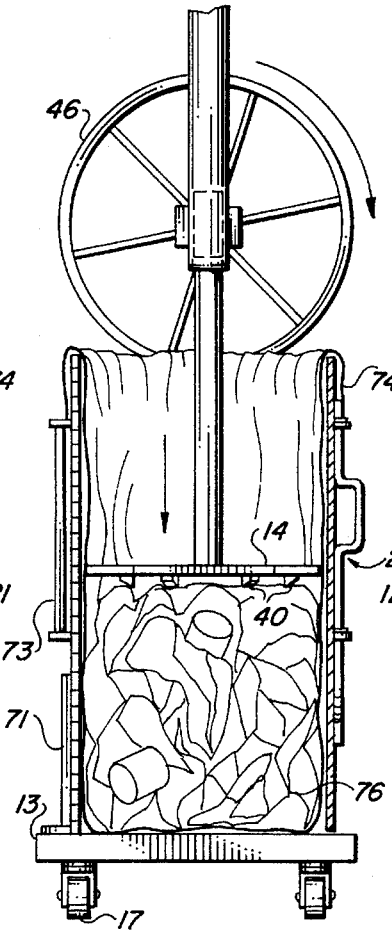
FIG. 6 is a cross sectional view taken along line 5—5 in FIG. 1 with the compaction plate adjusted downward.

The invention is the manually operated trash compactor 11 generally illustrated in FIG. 1. The compactor 11 includes a container 12 fixed to a platform 13. A compaction plate 14, disposed over the container 12, is mounted to a rack gear and pinion gear assembly 16 and is vertically adjustable to compress trash or refuse placed within the container 12. The compaction plate 14 and rack gear and pinion gear assembly 16 are pivotally mounted to post 18. The platform also has casters or wheels 17 so the entire trash compactor is mobile. The entire apparatus is preferably assembled with aluminum and stainless steel components to avoid rusting.

The container 12 may be constructed of aluminum plates to form a hexagonal receptacle that is about 30 inches tall aid has an outside diameter of about 20 inches. In order to balance the compactor 11 onto the platform, the container 12 is mounted eccentrically on the platform 13. For example, on a thirty square inch platform, the center of the container is placed 18½ inches from one side and 11½ inches from an opposing side, and is centered between the other two opposing sides of the platform 13.

As shown in FIG. 3 and 4, the container 12 is actually constructed of a first section 12A fixed to the platform, and a second section 12B pivotally secured to the first section 12A. The first section 12A of the container 12 is welded to platform 13 adjacent the post 18. A piano hinge 19 mounted intermediate the first 12A and the second 12B section of the container 12 permits a user to swing open the second 12B away from the post 18. A latch 21 is mounted on the container 12 opposite the hinge 19 so the second section 12B of the container opens away from the post 18. This construction of the container 12 enables a user to open the container 12 as shown in FIG. 3 to line the container with a trash bag 74 or remove a trash bag with compressed refuse.

Figure 9:
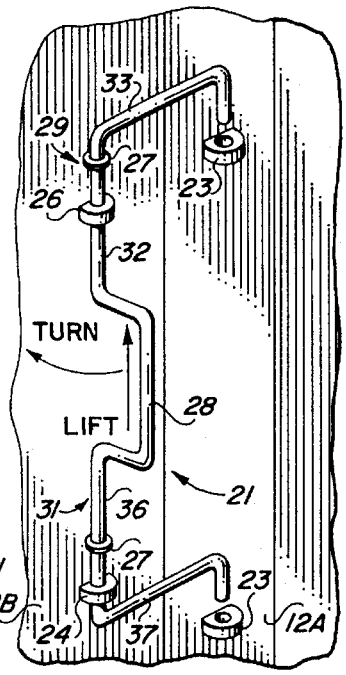
FIG. 9 is a perspective view of the latch and handle on the container.
Figure 16:
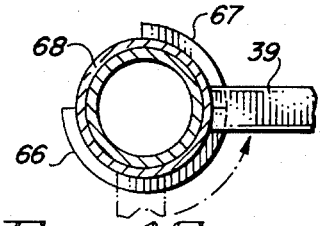
Figure 7:
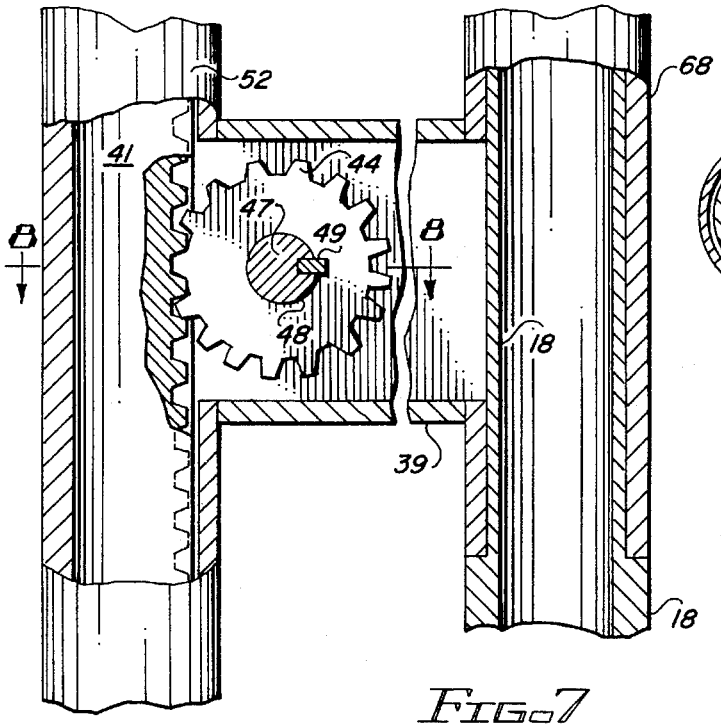
FIG. 7 is a cross sectional view taken along line 7—7 in FIG. 1.
Figure 8:
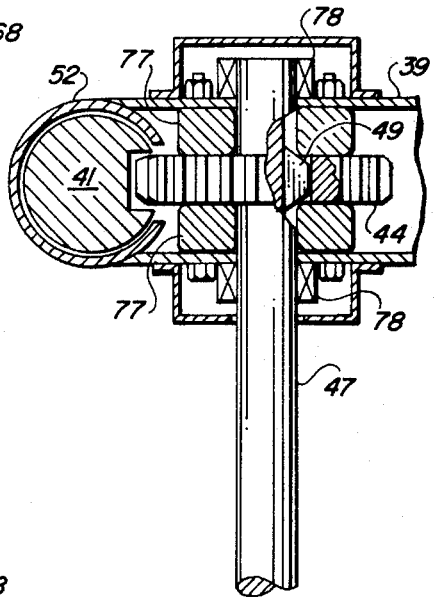
FIG. 8 is a cross sectional view taken along 8—8 in FIG. 7.

As shown in FIGS. 1, 4 and 9, the latch 21, mounted to the container 12, holds the container closed. This latch 21 is adapted to engage brackets 22 and 23 vertically aligned on the first section 12A and brackets 24 and 26 vertically aligned on the second section 12B. Each of the brackets is mounted to the container adjacent the edge of the respective sections 12A and 12B, opposite the hinge 19. Bracket 23 is slightly upwardly offset from horizontal of bracket 26; and bracket 24 is slightly downwardly offset from horizontal of bracket 26.

A handle 28 is disposed intermediate the brackets 24 and 26. Bolts 29 and 31 are integral to the handle and engage the brackets of the latch when the container is closed. Bolt 29 has a vertical bar 32 integral with the handle 28 that extends upward through bracket 26 and an L-shaped bar 33 that extends laterally to the bracket 22. Similarly, a lower bolt 31, integral the handle 28, has a vertical bar 36 that extends downward through bracket 24 and horizontal bar. An L-shaped bar 37 extends laterally to for engagement with the bracket 23. Bars 32 and 36 are rotatable within brackets 24 and 26 and slide up and down for vertical displacement of the latch 21. Rings 27 are mounted to the vertical bars 32 and 36 above brackets 24 and 26 to hold the latch in place.

As shown in FIG. 1, the latch 21 is in a closed position with the handle 28 of the latch in a plane substantially perpendicular a face of the container 12. In order to open the container 12, a user grasps the handle 28 and slightly lifts upward removing the L-shaped bars from the respective brackets 22 and 23. As illustrated in FIG. 9, handle 28 is rotated toward the second section 12B of the container 12. When the latch is in this released position, the user may pull the second section 12B open.

The rack gear and pinion gear assembly 16, previously identified, facilitates the selective vertical adjustment of the compaction plate 14, within the container 12. The entire assembly is held in aluminum sleeves 51 and 52, and gear housing 39 which is pivotally attached to post 18. Post 18 is 3"×½"×49½" aluminum cylinder mounted to platform 13 adjacent the first section 12A of container 12. The center of the post 18 is about five inches from the side of the platform 13 and about 3½ inches from the side of the container section 12A and aligned with the center of the container 12.

Figures 10, 11, 12, 13, 14:
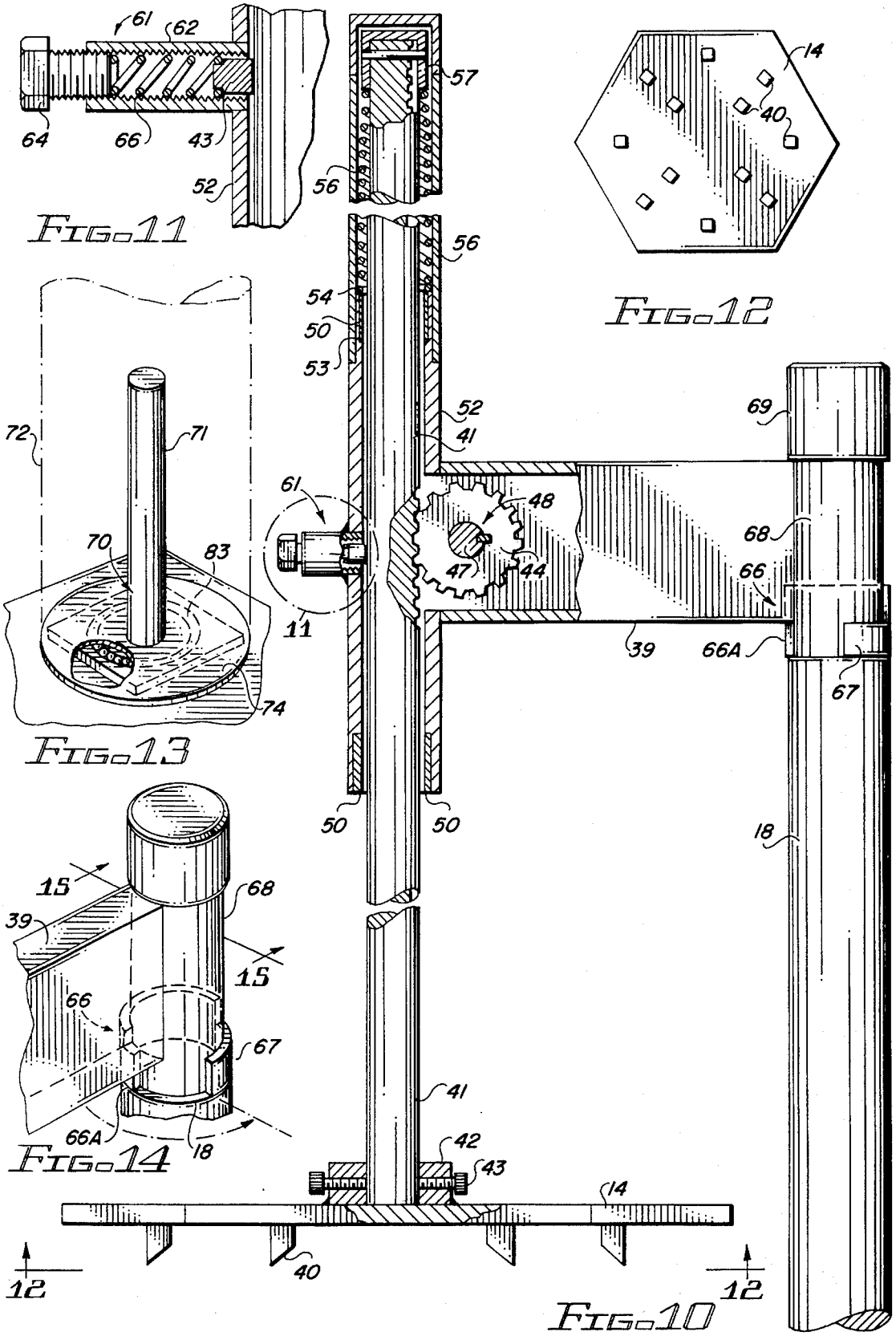
FIG. 10 is a cut away showing the rack gear and pinion gear system of the trash compactor.
FIG. 11 is the expanded view of inset 11 of FIG. 10.
FIG. 12 is a bottom view of the compression platen taken along line 12—12 in FIG. 10.
FIG. 13 is a perspective view of the trash bag spindle.
FIG. 14 is a perspective view of the pivot stops.

The rack gear and pinion gear assembly 16 is illustrated in FIG. 10. As shown therein the compaction plate 14 is mounted to the bottom of a rack gear 41. This particular embodiment uses a ring 42 welded to the plate 14 and pin 43 that extends through the rack gear 41. The rack gear 41 is held in a sleeves 51 and 52 which communicate with the housing 39 so the rack gear 41 engages a pinion gear 44 which is rotatably mounted in a gear housing 39. A drive wheel 46 is connected to the pinion gear 44 by a wheel shaft 47. The wheel shaft 47 extends from the drive wheel 46 through the pinion gear 44. The pinion gear has a key way 48 through which the wheel shaft 47 extends and key pin 49 engages to rotate pinion gear 44. The pinion gear 44 is approximately 3½ inches in diameter and the drive wheel is 28 inches creating a gear ratio of 1 to 3, or a one eight pound force ratio. The pinion gear 44 is centrally aligned in the housing 39 and with the shaft 47 by spacers 77. Collars 78 are bolted to the drive wheel shaft 47 and align and support the drive wheel shaft 47. The shaft 47 is not fixed to the spacers 77 or is free to rotate for operation of the pinion gear 44.

The rack gear 41 itself is preferably 36" long with an outside diameter of 2 inches. The rack gear 41 is held in an upper 51 and lower 52 sleeve. As shown in FIG. 10, the lower sleeve 52 is integral gear housing 39. The sleeve 52 is about ten inches long with an outside diameter of three inches. An upper two inch portion 53 of the sleeve 52 is shaven down to an outside diameter of slightly less than three inches. The upper sleeve is approximately twenty-eight inches long with an outside diameter of three inches, and fits over the upper portion 53 of the lower sleeve 52. Bolts are then threaded through the upper rack sleeve to contact the upper section 53 of the lower rack sleeve 52 mounting the upper rack sleeve 51 onto the first rack sleeve. Since it is bolted, the upper rack sleeve is removable for maintenance of the rack gear 41 and compression spring 56.

A brass or copper bushing 50 is fitted in the top and bottom of the lower rack sleeves 52. These bushings assist in the alignment of the rack gear 41 within the sleeve 52, and also provide a contact surface to prevent undo wear on the sleeve interior due to points of contact between the rack gear 41 and sleeve 52.

As shown in FIG. 10, a compression spring 56 fits over the rack gear 41, and as will be explained in more detail below, this compression spring 56 facilitates the automatic return of the compaction plate 14 to its starting position. The compression spring 56 is constructed of stainless wire with a diameter of 2.56 inches and has a 36" free length. The coiled length is 24.5 inches.

The spring rests on top of the lip 54 formed by the upper section 53 of sleeve 52. A spring retainer device 57 maintains the spring 56 on the rack gear 41. This retainer device includes a stainless steel ring with opposing apertures aligned with a hole drilled in the rack. A pin inserted through the ring and rack gear holes and extends through the rack gear and each end flush with the outside surface of the ring. The spring 56 abuts the bottom the retainer 57, and the extension force of the spring against the bottom retainer 57 maintains the rack gear from sliding through the first sleeves 51 and 52.

In order to operate the rack gear 41, a user rotates the drive wheel 46 in a counter-clockwise direction to actuate the pinion gear 44 in the same direction. The pinion gear forces the rack gear 41, and the compaction plate 14 vertically downward. As the rack gear 41 is adjusted downward the retainer compresses the spring 56. After refuse in the container is compacted to a desired level the drive wheel 46 is released. The tension in the spring 46 forces the rack gear upward and returns the compaction plate 14 to its starting position.

The rack assembly preferably includes clutch means or tension adjuster 61 to control the automated retraction of the rack when the drive wheel is released. This tension adjuster 61 includes a tube 62 in communication with the lower sleeve 52. A small spring inserted in the tube has a neoprene plug 63 at one end contacting the rack gear 41. A bolt 64 threaded in the tube 62 behind the spring provides for the selective adjustment of the plug 63 against the rack 41.

As described above, the rack gear and pinion gear assembly 16 includes gear housing pivotally attached to the post 18. A post sleeve 68 is welded to the gear housing and fits over the top of the post 18. The post has an outside diameter of three inches. An eleven inch top section is shaven to an outside diameter of about two and one half inches. The post sleeve 68 is eight inches long and also has an outside diameter of three inches so the post sleeve may freely rotate on the post 18. A cap 69 fits over the remaining portion of the post 18. With this arrangement of components the entire rack gear and pinion gear assembly 16 may be easily removed by simply sliding the post sleeve 66 off the post 18. Thus, the entire rack and pinion is removable for storage and/or maintenance.

A pair of stops 66 and 67 are mounted to the post 18 and post sleeve 68 so the rack gear and pinion gear assembly 16, with the compaction plate 14 is rotatable between an operating position with the compaction plate 14 disposed over the container to a storage position, as shown in FIG. 3. Stops 66 and 67 are mounted to the sleeve 68 and post 18 as shown in FIG. 14 to prevent rotation of the rack assembly beyond 90° from its operating position with the compaction plate disposed over the container. This arrangement of the stops 66 and 67 provides for rotation in only a single direction. Stop 66 is actually mounted to sleeve 68 and a portion 66A of stop 68 extends to over the post 18. This lower portion 66A contacts the stop 67 for the positioning of the compaction plate 14 between these operating and loading positions.

The FIG. 14 illustrates the rack and pinion assembly with the compaction plate 14 in operational position. As one may appreciate the sleeve 68 is rotational only in a single direction to a position perpendicular to the operational starting position of the compaction plate 14.

This compactor 11 may also be equipped with a trash bag storage and dispenser means which includes a turntable 70 mounted in the corner of platform 13 next to the post 18 on the side of hinge 19. A trash bag spool 72 is placed over the turntable. A guide or feed rod 73 is mounted to container 12 adjacent the hinge 19. A post 71 that is fixed to the platform. Disc 74 is place over the post 71 on the turntable 70 and rotates about the post 71. The turntable has sets of ball bearings 78 to facilitate rotation of the disc 74.

In order to use the compactor 11, the compaction plate 14 is rotated away from the container 12. A trash bag 75 is pulled through the guide or feed rod 73 and taken from the spool 72. The container 12 is opened to place the bag in the container 12. The top of the bag 75 is preferably draped over the outside of the container 12 so it engages the brackets 27 and 23 of the latch 21 on one side and the top bracket of the guide 73. This holds the trash bag 75 in place as the plate 14 is adjusted downward into the container to compact trash 76. A user then closes the container 12 and engages the latch 21. The compaction plate is then rotated back to its starting position. When the container is filled with trash 76, the drive wheel 46 is rotated to adjust the compaction plate 46 downward and compact the refuse within the bag 75. When the drive wheel is released, the compression spring retracts automatically returning the compaction plate 14 to its starting position. When the trash bag 75 is filled, the container is opened, the trash bag is tied and taken to the refuse container for disposal.

The compaction plate 14 is preferably equipped with vent pins 40 mounted to the bottom of the plate 14. As the trash 76 is compacted some of the containers retain air. The vent pins 40 puncture the containers to vent excess air and assist in compression of the trash 76. In addition, drain holes 77 are drilled in the bottom of the platform 13 to allow drainage of liquids or fluids when cleaning the compactor.

While I have disclosed the preferred embodiment of my invention, it is not intended that this description in any way limits the invention, but rather this invention should be limited only by a reasonable interpretation of the now recited claims.

What we claim is:

1. A manually operated trash compactor, comprising:

(a) a refuse container with vertically disposed sides forming an opening, said container mounted on a platform;

(b) a compaction plate disposed over the opening of the container, said compaction plate selectively adjustable downward into the container from a starting position;

(c) a rack gear and pinion gear assembly with said compaction plate mounted to the rack gear;

(d) means, connected to the rack gear and pinion gear assembly, for actuating the pinion gear in a direction to drive the rack gear and compaction plate downward into the container;

(e) means, mounted in the rack gear and pinion gear assembly, for automated retraction of the rack gear and compaction plate to a starting position;

(f) said refuse container includes a first section fixed to the platform and a second section pivotally attached to said first section;

(g) latch means mounted on the container for maintaining the first and second container section in a closed position; and (h) said latch means includes a pair of brackets vertically aligned on the container first section and a pair of brackets vertically aligned on the second section, and a handle integral with an upper bar member and lower bar member, with said disposed intermediate the brackets on the second section and each said bar member extending through a bracket on the second section of the container, and each said bar member having an L-shaped member for engagement with a corresponding bracket on the first section of the container.

2. A manually operated flash compactor as defined in claim 1 further including means for pivoting the rack gear and pinion gear assembly and the compaction plate between the position of the compaction plate disposed over the container to a position lateral of the container.

3. A manually operated trash compactor as defined in claim 2 wherein said pivoting means includes a sleeve attached to the rack gear and pinion gear assembly and pivotally attached to a post fixed to the platform adjacent the container.

4. A manually operated trash compactor as defined in claim 1 wherein said automated retraction means includes a compression spring mounted over the rack gear of the rack gear and pinion gear assembly.

5. A manually operated trash compactor as defined in claim 4 further including a spring retention means mounted to the top of the rack gear, said spring abutting the bottom of the retention means and retaining the spring on the rack gear during compression of the spring.

6. A manually operated trash compactor as defined in claim 1 further including a plurality of vent pins mounted to the bottom of the compression plate.

7. A manually operated trash compactor as defined in claim 1 further including a means for controlling the retraction speed of the rack gear and compaction plate to a starting position.

8. A manually operated trash compactor as defined in claim 7 wherein said rack gear and pinion gear assembly includes a housing encasing the rack gear and pinion gear, and said retraction control means includes a polymeric plug mounted in said casing and contacting said rack gear, and a means for selectively adjusting the frictional contact between the plug and rack gear.

9. A manually operated trash compactor, comprising:

(a) a mobile platform;

(b) a refuse container mounted on the platform;

(c) a rack gear and pinion gear assembly mounted on the platform;

(d) a compaction plate mounted to the bottom of the rack gear;

(e) means, mounted to the rack gear and pinion gear assembly, for pivoting the compaction plate between an operational position disposed over the container to a position lateral of the container;

(f) means, connected to the pinion gear, for rotating the pinion gear in a direction for the selective downward adjustment of the rack gear and compaction plate into the container (g) means, mounted in the rack gear and pinion gear assembly, for the automated retraction of the rack gear and compaction plate after the downward adjustment of the rack gear; and (h) said automated retraction means includes a compression spring placed over the rack gear.

10. A manually operated trash compactor as defined in claim 9 further including a means for retaining the compression spring on the rack gear during downward adjustment of the rack gear.

11. A manually operated trash compactor as defined in claim 9 further including a means for controlling the speed of retraction of the rack gear and compaction plate.

12. A manually operated trash compactor as defined in claim 11 wherein said rack gear and pinion gear assembly further includes a gear housing and said retraction controlling means includes a polymeric plug mounted in said housing and in contact with the rack gear, and a spring and a bolt means attached to the plug for the selective adjustment of the friction between the plug and the rack gear.

13. A manually operated trash compactor as defined in claim 9 wherein said refuse container includes a first section fixed to the platform and a second section pivotally mounted to said first section.

14. A manually operated trash compactor as defined in claim 13 further including a latch means for maintaining the first and second sections of the container in a closed position during operation of the compactor.

15. A manually operated trash compactor as defined in claim 9 further including means, mounted on the platform, for storage and dispensing trash bags.

16. A manually operated trash compactor as defined in claim 15 wherein said trash bag dispenser and storage means includes a turntable placement of a roll of bags and a feeder mounted to the container.

17. A manually operated trash compactor, comprising:

(a) a refuse container mounted on a mobile platform;

(b) a compaction plate disposed over the container, said compaction plate pivotal between a position disposed over the container and a position lateral of the container;

(c) a rack gear and pinion gear assembly, with said compaction plate mounted to the bottom of the rack gear, and said rack gear having selective downward adjustment projection of the compaction plate into the container from a starting position, and automatically retractable from a operation position to the starting position;

(d) means, connected to the pinion gear, for rotating the pinion gear in a direction for downward adjustment of the rack gear and projection of the compaction plate into the container; and (e) a trash bag dispenser and storage means on the platform next to the container.

18. A manually operated trash compactor as defined in claim 17 further including vent pins on the bottom of the compaction plate.

19. A manually operated trash compactor as defined in claim 17 wherein said refuse container includes a first section fixed to the platform and a second section pivotally attached to the container first section, and said compactor having a latch means for maintaining the container closed during operation.

20. A manually operated trash compactor as defined in claim 19 wherein said latch means includes a pair of brackets vertically aligned on the container first section and a pair of brackets vertically aligned on the second section, and a handle integral with an upper bar member and a lower bar member, with said handle disposed intermediate the brackets on the second of the container, and each said bar member having an L-shaped member for engagement with a corresponding bracket on the first section of the container.

21. A manually operated trash compactor as defined in claim 17 further including a compression spring placed over the rack gear and means for retaining the spring on the rack gear during operation of the compactor, said spring facilitating the automated retraction of the rack gear and compaction plate to a starting position, and a means for controlling the speed of retraction of the rack gear.

22. A manually operated trash compactor as defined in claim 17 wherein said means for rotating the pinion gear includes a drive wheel having a drive shaft linked with the pinion gear.

* * * * *